United States Patent [19]

Bakker

[11] 4,391,605

[45] Jul. 5, 1983

[54] TEXTILE TREATMENT

[75] Inventor: Paul G. H. Bakker, Ilkley, England

[73] Assignee: Wool Development International Limited, London, England

[21] Appl. No.: 291,118

[22] Filed: Aug. 7, 1981

[30] Foreign Application Priority Data

Aug. 7, 1980 [GB] United Kingdom ..... 8025844

[51] Int. Cl.[3] ..... D06M 13/18; D06M 13/46

[52] U.S. Cl. ..... 8/495; 252/8.8

[58] Field of Search ..... 252/8.8; 564/291; 8/495

[56] References Cited

U.S. PATENT DOCUMENTS 3,862,045 1/1975 Sato et al. ..... 252/8.8

3,974,076 8/1976 Wiersema et al. ..... 252/8.8

FOREIGN PATENT DOCUMENTS 54-160890 12/1979 Japan ..... 252/8.8

OTHER PUBLICATIONS

Tex. Chem. & Colorist, Products/77, vol. 8, Jul. 1976, p. 143.

*Primary Examiner*—Maria Parrish Tungol

*Attorney, Agent, or Firm*—Andrew D. Maslow

[57] ABSTRACT

A process of imparting anti-static properties to textile materials, especially carpets, comprises treating the material with an aqueous solution of a quarternary ammonium salt and a water soluble polyether. Quarternary ammonium salts, containing three $C_8$–$C_{10}$ alkyl or aralkyl groups, normally insoluble in water, are soluble in the polyether; and compositions of quarternary ammonium salt and polyether may be diluted with water and applied to textile material to produce an anti-static finish.

13 Claims, No Drawings

TEXTILE TREATMENT

The invention relates to a method of treating textiles, in particular to reduce build-up of charges of static electricity, and to compositions therefor.

When carpets are walked upon, in dry conditions, there tends to be charge separation between the carpet and the soles of the walker's shoes. This results in a charge of static electricity building up on the carpet and on the body of the walker. When the latter touches any earthed metal object he may receive an unpleasant electric shock. Static appears to be a particular problem with contract carpeting, notably in offices, hotels and the like where large areas are carpeted and the atmosphere is relatively dry. Apart from being a nuisance, discharges of static electricity can be damaging or even dangerous in certain circumstances, for example if there is sensitive electrical or electronic equipment in the room or if flammable materials are present.

To prevent static electricity from building up to such proportions, it has been proposed to render the carpet or carpet yarns conducting, so that any charge is quickly earthed. One method of doing this involves spinning fine stainless steel filaments in with the textile fibres of the carpet yarn. Adding a conductive backing to the carpet completes the circuit and allows charges from each tuft of carpet pile to be led away to earth. Such a method however is costly and is usually only justified when the carpet is to be used in high-risk areas. A cheaper method is to treat the carpet with a chemical anti-static agent, e.g. a humectant, which attracts available moisture and thus renders the pile conductive.

It has also been proposed to use a chemical anti-static agent which probably operates in other ways, for example, a quarternary ammonium salt. The salts are reasonably effective but they have their limitations. For example, those having relatively low molecular weights are water soluble and, therefore, convenient to apply. Nevertheless, they suffer from the defect that carpets treated with them soon lose their anti-static properties when subjected to wear or when they are shampooed. The salts having higher molecular weights are insoluble in water and, therefore, they have to be applied either as solutions in organic solvents or as aqueous emulsions or dispersions. The use of solvents which are generally either flammable or toxic is both costly and presents problems to the manufacturer. Emulsions and dispersions tend either to be unstable and, therefore, liable to break down, leading to uneven treatments, or contain dispersing agents which may have an undesirable effect on the textile, especially if it is to be subjected to later processing such as dyeing.

We have now found that certain quarternary ammonium salts which have higher molecular weights and are insoluble in water dissolve readily in concentrated aqueous solutions of certain water soluble polyethers. Furthermore, these solutions can be diluted readily with further quantities of water, and can be applied conveniently to textiles, to give excellent anti-static properties.

Accordingly, this invention comprises a water dispersible composition comprising a quarternary ammonium salt containing a methyl group and three alkyl or aralkyl groups containing from eight to ten carbon atoms, and a water soluble polyether.

A further aspect of this invention provides a process of imparting anti-static properties to textile material which comprises treating the material with an aqueous solution of a composition according to the invention.

The quarternary ammonium salt may have either substituted or unsubstituted alkyl or aralkyl groups in the quarternised ammonium ion. An especially effective salt is sold by General Mills Chemicals Inc. under the name ALIQUAT 336. The compound has the formula:

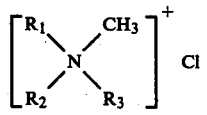

wherein $R_1$, $R_2$ and $R_3$ are unsubstituted alkyl groups containing from 8 to 10 carbon atoms. Aliquat 336 consists mainly of tri-caprylyl methyl ammonium chloride wherein $R_1$, $R_2$ and $R_3$ are mostly $C_8$ alkyl groups.

The water soluble polyethers used in the practice of the invention may be obtained by the condensation of an alkylene oxide, for example, ethylene or propylene oxide with a wide variety of aromatic, aliphatic or heterocyclic compounds containing an active hydrogen atom, such as for example, alkyl phenols, particularly nonyl phenol, polyols, such as glycerol, and fatty acids. Especially suitable polyethers include a polyoxy alkylene derivative sold by Shell under the Trade Mark CONUS KS; a condensation product of ethylene oxide and nonyl phenol which is sold by ICI under the Trade Mark LISSAPOL N; a fatty acid polyglycol ester sold by Farbwerke Hoechst under the Trade Mark LEOMIN LS and a condensation product of ethylene oxide and lauric acid which is sold by Atlas Chemical Industries under the Trade Mark MILUBE N29.

Concentrated solutions of the anti-static agent and the polyether may be made conveniently merely by mixing 1 part by weight of the quarternary ammonium salt with from 1–5 parts by weight of the polyether at ambient temperatures. The resulting products are generally clear liquids although on occasion they may be opaque. For purposes of application the mixtures are generally diluted with from 10–100 parts by weight of water. The resulting solutions also are generally clear but may on occasion be opaque and tend to separate out into two phases. When this occurs simple stirring or other mild agitation is sufficient to bring them into a condition for application. One surprising aspect of the present compositions is that on dilution with water the insoluble quarternary salt is not precipitated as is the case when, for example, a solution of Aliquat 336 in iso-propanol or acetone is diluted. Whilst this invention is not to be restricted by any theory as to the true nature of these compounds, it appears as though the quarternary salt and the polyether combine to form a complex which is either completely water soluble or is so easily dispersible in water as to enable it to be applied to textile materials uniformly. The diluted solutions are used in sufficient amount to deposit from 0.2% to 1.0% by weight of the anti-static agent on the textile and preferably from 0.5% to 0.7% by weight. They can be applied at ambient or elevated temperatures, preferably at 20°–50° C. Solutions can be applied at any convenient stage in the processing of the textile, at any stage in its conversion from raw fibre or filament to the finished product.

For example, in the manufacture of wool products the compositions can be applied:

(a) to loose wool during scouring, as an additive to a spinning lubricant, or as an after treatment following stock dyeing (b) to yarn, during scouring or as an after treatment following dyeing (c) to carpets, as an additive to a back coating composition, that is, a composition containing an adhesive to bond a primary and secondary backing for carpet, or as an after treatment following piece dying, or application to carpet backing material, e.g. jute yarn or fabric.

This invention is illustrated by the following Examples:

EXAMPLES 1-4

The following Examples describe the preparation of 4 concentrated liquid compositions containing Aliquat 336 and different polyethers. In each Example, Aliquat 336 was mixed in a beaker with each of the polyethers identified below in the ratios stated. The compositions were then diluted 10-fold with water and allowed to stand for 12 hours.

The compositions had the following characteristics:

| Example No. | Polyether | Ratio of Polyether to Aliquat | Appearance of concentrated liquid | Appearance of concentrated liquid diluted 10-fold with water |
|---|---|---|---|---|
| 1 | CONUS KS | 2:1 | Clear | Clear, stable |
| 2 | LISSAPOL N | 1:1 | Opaque | Opaque |
| 3 | LEOMIN LS | 3:2 | Clear | Opaque |
| 4 | MILUBE N29 | 3:1 | Clear | Clear, stable |

EXAMPLE 5

This Example illustrates the use of one of the present compositions in the treatment of loose wool while it is being scoured.

A clear solution of the Aliquat preparation made according to Example 2 above and containing 0.2 g/l of Aliquat was fed into the second bowl of a 4-bowl tape scouring system during the passage of wool. The temperature of the scour liquor containing the Aliquat was maintained at 45°-50° C. and the rate of passage of wool through the bowl was adjusted so that the wool remained in the second bowl for 25-40 seconds before passing on to the third and fourth bowls where the treated wool was washed with clean water at a temperature of 35°-40° C. During this process the wool acquired 0.7% by weight of the Aliquat.

Carpets subsequently made form the treated wool were found to have good anti-static properties. The treatment was even and durable.

EXAMPLE 6

This Example illustrates the treatment of wool fibres which have been previously dyed.

Wool fibres were first dyed according to conventional practice with metal complex dyes. They were then placed in a fresh bath at a temperature of 20°-25° C. over a period of 10 minutes with a solution of Aliquat obtained from Example 2 above containing 0.05 g/l of Aliquat. The bath was maintained at the above temperature for a further 10 minutes after which the treated fibres were washed with clean water. During the process from 90-95% of the Aliquat exhausted on to the wool which acquired 0.5% by weight of the anti-static agent.

Carpets made from the treated fibres were also found to have good anti-static properties.

EXAMPLES 7-11

A number of carpet samples were treated, after dyeing, in a fresh bath with a composition similar to the compositions described in Examples 1-4 at a temperature between 20° and 25° C. for 10 to 15 minutes at a liquor ratio of 20:1. After treatment the carpets were hydro-extracted and dried without rinsing. The carpets were then conditioned to a relative humidity of 25% rh and a temperature of 23° C. for a minimum of three days. Following this a "stroll test" was conducted by means of a person walking up and down the carpet holding an electrode which would register the body voltage build-up. The tester's shoe soles are of different specified compositions as shown in the table following.

The results are as follows:

| | | BEFORE TREATMENT | | | AFTER TREATMENT 0.5% active compound (oww) | | |
|---|---|---|---|---|---|---|---|
| Code | Fibre | (iso) Composition Sole | BAM Rubber Sole | (iso) P.V.C. Sole | Comp. Sole | B.A.M. Sole | P.V.C. Sole |
| CRAGSMAN (loop Berber) | WOOL | −9,750 | −7,600 | −5,000 | +300 | −600 | −200 |
| S.F.C. BLUE VELOUR | NYLON | −15,250 | −11,500 | −11,000 | −700 | −900 | +300 |
| LUXURIANT PLUSH | POLYESTER | −3,200 | −10,750 | −4,750 | 0 | −400 | −200 |
| BLUE VELOUR | ACRYLIC (1) | −1,100 | −6,400 | −4,100 | +500 | −500 | +100 |
| BLUE LOOP-PILE | ACRYLIC (2) | −250 | −5,250 | −2,600 | −100 | −300 | −100 |

Cragsman: 100% wool loop-pile, tufted, "berber-style", secondary backed.
Nylon: 100% polyamide, cut-pile, tufted, secondary backed.
Luxuriant: 100% polyester, shag-pile, tufted, secondary backed.
Acrylic (1): 100% polyacrylic, loop-pile, tufted, secondary backed.
Acrylic (2): 100% polyacrylic, cut-pile, tufted, secondary backed.

As can be seen from the results above the treatment markedly reduces static build-up with all sole compositions on the carpets treated with the composition of the invention.

EXAMPLES 12-14

Fabric samples, described in the table below, were treated in the same manner as the carpet samples described in examples 7-11. The build-up of body voltage was measured by means of a "cloak test" in which a person wearing a cotton jacket or a PVC T-shirt had the fabric sample draped over his shoulders in a cloak like fashion and then removed. The tester carried an electrode to measure body voltage as before.

The results are as follows:

| | Body Voltage - Cloak Test | |
|---|---|---|
| Fabric Sample | Untreated Fabric | Treated Fabric (0.5% active ingredient owf) |
| 100% wool (200 g/m$^2$, 2 × 2 twill) | −6,200 | +2,250 |
| 100% Acrylic (Hi-bulk Courtelle plain interlock knitted fabric) | +3,000 | +300 |
| 100% polyester (440 g/m$^2$ sport shirt material, plain interlock knitted) | +4,000 | +400 |

As can be seen the treatment substantially reduces static build-up on all the fabrics tested.

I claim:

1. A composition for treating textiles which comprises a quarternary ammonium salt containing a methyl group and three alkyl or aralkyl groups containing from eight to ten carbon atoms, and a water soluble polyether.

2. A composition as claimed in claim 1 in which the quarternary ammonium salt is tri-caprylyl methyl ammonium chloride.

3. A composition as claimed in claim 1 in which the polyether is obtained by the condensation of an alkylene oxide with an aromatic, aliphatic or heterocyclic compound containing an active hydrogen atom.

4. A composition as claimed in claim 3 in which the compound containing an active hydrogen atom is an alkyl phenol, polyol or a fatty acid.

5. A composition as claimed in any one of claims 1 to 4 in which the polyether is a condensation product of ethylene oxide and nonyl phenol.

6. A composition as claimed in any one of claims 1 to 4 containing one part by weight of quarternary ammonium salt and from one to five parts by weight of polyether.

7. A method of imparting anti-static properties to textile materials which comprises treating the material with an aqueous composition as claimed in any one of claims 1 to 4.

8. A method as claimed in claim 7 in which the composition is diluted with from ten to one hundred parts by weight of water.

9. A method as claimed in claim 7 in which the composition is used in sufficient amount to deposit from 0.2 to 1 percent by weight of the quarternary ammonium compound onto textiles.

10. A method as claimed in claim 9 in which the amount is from 0.5 to 0.7 percent by weight.

11. A method as claimed in claim 7 in which the compositions are applied to textile materials at a temperature of from 20° to 25° C.

12. A method as claimed in claim 7 in which the textile material is a wool textile material.

13. A method as claimed in claim 7 in which the textile material is treated after dyeing.

* * * * *